US006568868B1

(12) United States Patent
Hammer

(10) Patent No.: US 6,568,868 B1
(45) Date of Patent: May 27, 2003

(54) FASTENING ARRANGEMENT FOR JOINING BODY COMPONENTS

(75) Inventor: Thorge Hammer, Weyhausen (DE)

(73) Assignee: Volkswagen AG (DE)

( * ) Notice: Subject to any disclaimer, the term of this patent is extended or adjusted under 35 U.S.C. 154(b) by 0 days.

(21) Appl. No.: 09/678,959

(22) Filed: Oct. 4, 2000

Related U.S. Application Data

(63) Continuation of application No. PCT/EP99/01808, filed on Mar. 18, 1999.

(30) Foreign Application Priority Data

Apr. 9, 1998 (DE) ..... 198 16 014

(51) Int. Cl.[7] ..... B25B 5/16
(52) U.S. Cl. ..... 403/31; 269/22; 269/266
(58) Field of Search ..... 403/31, 34–39; 269/22, 266, 265, 86; 228/44.3, 49.4; 29/281.1, 281.5, 559, 464

(56) References Cited

U.S. PATENT DOCUMENTS

| | | | | | |
|---|---|---|---|---|---|
| 2,040,466 | A | * | 5/1936 | Christy | 269/22 |
| 2,556,306 | A | * | 6/1951 | Vickers | 269/22 |
| 3,608,809 | A | * | 9/1971 | Cushman | 228/44 |
| 4,093,176 | A | * | 6/1978 | Cotastin | 249/22 X |
| 4,286,490 | A | * | 9/1981 | Spengler | 249/22 X |
| 4,643,408 | A | | 2/1987 | Stoll | 269/22 |
| 4,813,657 | A | | 3/1989 | Todd | 269/22 |

FOREIGN PATENT DOCUMENTS

| | | | | |
|---|---|---|---|---|
| DE | 7438202 | | 4/1973 | |
| DE | 114038 | | 8/1974 | |
| DE | 114 038 | * | 7/1975 | B61D/17/00 |
| DE | 3716232 | | 5/1987 | |
| DE | 19622575 | | 6/1996 | |
| EP | 0449044 | | 3/1991 | |
| FR | 800795 | | 1/1936 | |
| FR | 2.207.780 | * | 6/1974 | B23Q/3/00 |
| FR | 2207780 | | 6/1974 | |
| GB | 587971 | | 5/1947 | |
| GB | 1339672 | | 12/1973 | |
| GB | 2185942 | | 5/1987 | |
| GB | 2273960 | | 6/1994 | |
| JP | 57-127638 | * | 8/1982 | 29/559 |

OTHER PUBLICATIONS

Abstract: JP 57–127638 08–1982 JP Mitsubishi Heavy IND LTD 29/559*

* cited by examiner

*Primary Examiner*—Lynne H. Browne
*Assistant Examiner*—Michael P Ferguson
(74) *Attorney, Agent, or Firm*—Baker Botts LLP

(57) ABSTRACT

A fastening arrangement for joining sheet metal car body components has a locating surface on which the car body components are supported and has a fastening component that is movable in the direction toward the locating surface and can be fixed in relation to that surface and includes compression elements cooperating with a pneumatic or hydraulic pressure membrane. The fastening component advantageously pivots around a rotary joint that can be locked in relation to the locating surface. Both the fastening component and the locating surface can have three-dimensionally formed 3D contours.

13 Claims, 2 Drawing Sheets

FASTENING ARRANGEMENT FOR JOINING BODY COMPONENTS

REFERENCE TO RELATED APPLICATION

This application is a continuation of International Application No. PCT/EP99/01808 filed Mar. 18, 1999.

BACKGROUND OF THE INVENTION

This invention relates to fastening arrangements for joining car body components, particularly car body components which are made of sheet metal, which include a locating surface on which the car body components can be supported and compression elements cooperating with a pneumatic and/or hydraulic pressure membrane for pressing the car body components against each other or against the locating surface.

A fastening arrangement of the type mentioned above is disclosed in German Offenlegungsschrift No. 196 22 575. With such a fastening arrangement two pieces of sheet metal of a car body, for example, can be pressed against each other so that they can be welded together along a connecting seam. When the sheets are to be welded together by a laser or an electron beam, the two sheets must be pressed against each other firmly enough that any waviness in the sheets is sufficiently minimized that a gap of preferably less than 0.2 mm remains between the sheets. The fastening arrangement described in this reference has, within each of a plurality of hollow bodies, a substantially tubular extensible element that can be acted upon by pneumatic or hydraulic fluid under pressure to force cylinders out of the hollow body, which then exert local pressure on, for example, the upper one of the two metal sheets. Because the hollow bodies are rigid and the cylinders acting on the surface of the sheet must have a minimum spacing, three-dimensionally shaped sheets cannot as a rule be pressed against each other sufficiently by the previously known fastening arrangements that they can be welded together by a laser or an electron beam to produce a connecting seam of the desired quality.

SUMMARY OF THE INVENTION

Accordingly, it is an object of the present invention to provide a fastening arrangement for joining car body components which overcomes disadvantages of the prior art.

Another object of the invention is to provide a fastening arrangement for joining car body components in which car body components can be pressed against each other uniformly and firmly enough so that welding of car body components, especially by a laser or an electron beam, produces a connecting seam of good quality.

These and other objects of the invention are attained by supporting plurality of compression elements and a pressure membrane on a fastening component that is movable in a direction toward a locating surface and can be fixed in relation to the locating surface. Preferably, the fastening component can be moved along the greater part of the path of motion toward the locating surface which is required for fastening, so that the compression elements need only be moved by the compression membrane along a short residual path. Consequently, the pneumatic and/or hydraulic pressure system and the pressure membrane can be made smaller and more simple and hence more inexpensive. In addition, moving the car body components to be joined into and out of the device is simplified. The arrangement according to the invention makes it possible for car body components such as, for example, sheet metal components, to be pressed against each other with little or no gap in a simple fashion.

Advantageously, the fastening component is capable of pivoting in relation to the locating surface about a lockable rotary joint. With this arrangement, motion of the fastening component along the main fastening path by simple pivoting of the fastening component in relation to the locating surface is possible. It is, of course, alternatively possible, for example, to make the fastening component linearly movable toward and away from the locating surface.

According to a preferred embodiment of the present invention, a hollow body which can accommodate a pressure membrane, preferably in the form of a tubular extensible element, is attached to the fastening component and the tubular extensible element is capable of being coupled to a pneumatic and/or hydraulic pressure line.

According to one embodiment of the present invention, the hollow body has a U-shaped cross section and is open on the side facing the locating surface so that the pressure membrane can act on portions of the compression elements adjacent to the open side. In this case, the compression elements advantageously are pivotally attached to the hollow body and desirably have at least a substantially L shape, with one leg extending approximately parallel to the locating surface and another leg extending approximately perpendicular to the locating surface. The ends of the approximately perpendicular legs compression elements facing the location surface are formed with a compression curve in order to avoid depressions in the surface of the car body components due to bearing pressure applied by the leg ends. The point of engagement of the pressure membrane and the legs extending approximately parallel to the locating surface preferably is located near the articulated connection of the legs to the hollow body, so that a relatively small motion produced by extension of the pressure membrane causes a relatively large motion of the legs extending approximately perpendicular to the locating surface.

The compression elements advantageously are mounted substantially close together in a direction which is perpendicular to the legs and approximately parallel to the locating surface, and the width of the legs is dependent on the waviness of the car body components. The fact that the compression elements are mounted close together assures that, even in the case of high residual waviness of the car body components, the gap between the surfaces of the components at each point of the planned weld seam is satisfactorily minimized. The width of the compression elements, which may alternatively be variable along the contour of the planned wield seam, may be appropriately selected according to the waviness produced by the roughly three-dimensional shape of the car body components.

According to an alternative embodiment of the invention, the hollow body has a substantially rectangular cross section and the side of the hollow body facing the locating surface has orifices for guiding the compression elements. In this case, the compression elements advantageously constitute pressure cylinders, each of which has a head that cooperates with the pressure membrane.

The locating surface may consist of the surface of a flat plate. However, in the event that three-dimensionally (3D) shaped sheets are to be welded together, it is advisable to configure the locating surfaces as a three-dimensionally formed 3D contour that at least substantially conforms to the contour of the car body components to be welded together.

The fastening component may correspondingly comprise or consist exclusively of a flat plate for supporting the hollow body. However, when three-dimensionally shaped sheets are to be welded together, it is advisable for the fastening component to comprise a three-dimensionally formed 3D contour, which at least substantially conforms to the contour of the sheets to be welded together. In this case, it is advantageous to fasten the hollow body to the underside of the 3D contour formed by the fastening component.

BRIEF DESCRIPTION OF THE DRAWING

Further objects and advantages of the invention will be apparent from a reading of the following description in conjunction with the accompanying drawings, in which.

DESCRIPTION OF PREFERRED EMBODIMENTS

Figure 1:
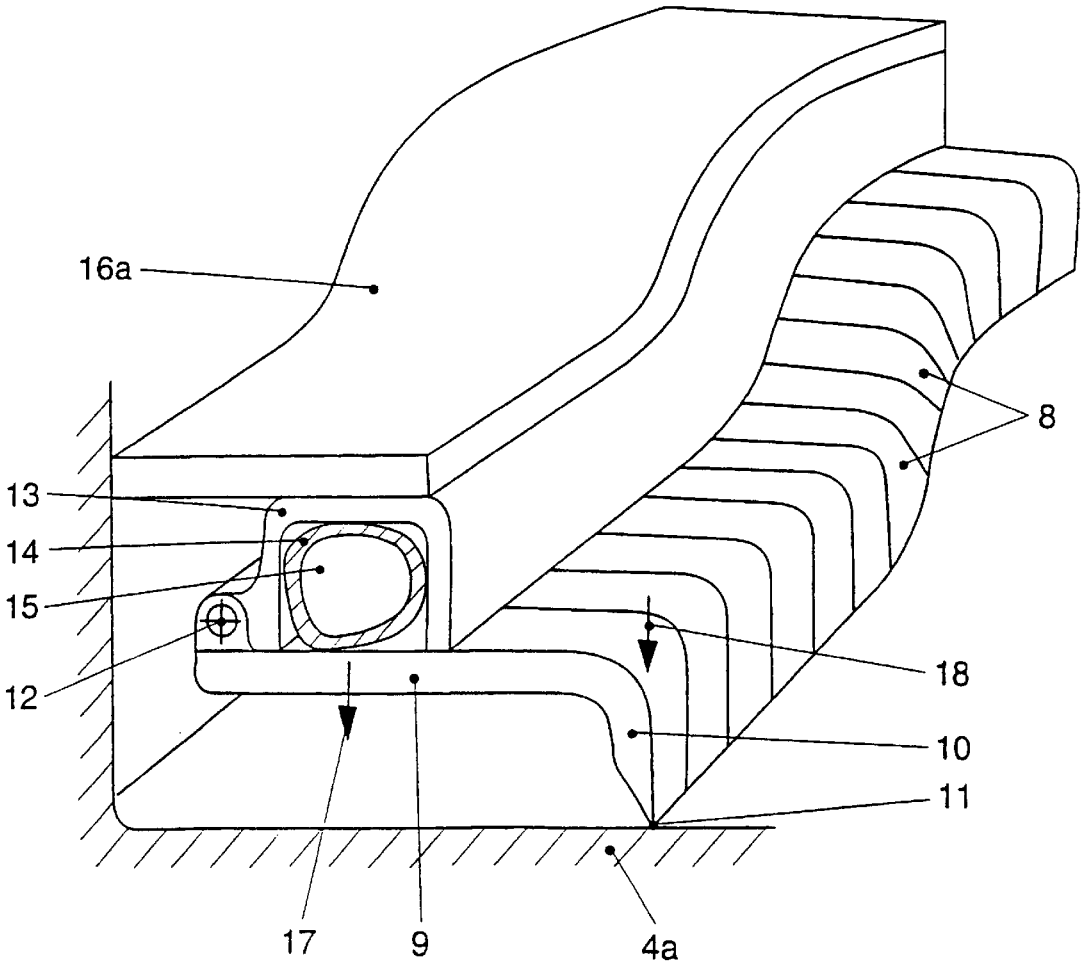
FIG. 1 is a perspective schematic view illustrating a representative embodiment of a fastening arrangement according to the invention.
Figure 2:
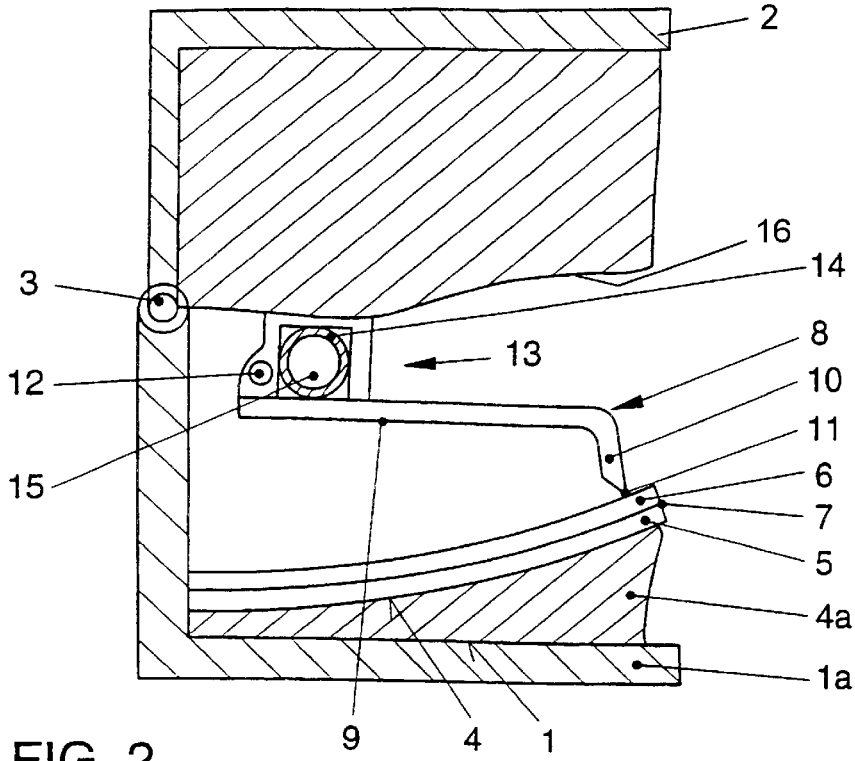
FIG. 2 is a cross section and view taken through the fastening arrangement of FIG. 1.

The typical embodiment of the invention illustrated in FIGS. 1 and 2 includes a flat, horizontal baseplate 1*a* and a counterplate 2 which is pivotable with respect to the baseplate 1*a* about a lockable rotary joint 3. A lower 3D contour plate 4*a* having a lower 3D-contour surface 4 may be fixedly or removably mounted on the baseplate 1*a* so that the contour surface 4*a* can serve as a locating surface for two three-dimensionally shaped sheets 5 and 6 that are to be welded together by a fillet weld, for example by a laser beam, along a connecting line 7.

Pressure is exerted locally at multiple points on the upper side of the upper sheet 6 by a plurality of compression elements 8. In the embodiment illustrated in FIG. 1 and FIG. 2, each of the compression elements 8 has a long, substantially horizontally aligned leg 9 and a short leg 10 which is connected with the long leg 9 and extends substantially vertically and ends in a pressure curve 11 at its underside. At its end remote from the vertical leg 10, the approximately horizontally extending leg 9 is pivotally hinged by a joint 12 to a hollow body 13. The hollow body 13 has a U-shaped cross section which is open toward the bottom and surrounds a pressure hose 14 having an inner chamber 15 that can be internally pressurized through pneumatic or hydraulic connections, not illustrated. Torsion springs (not illustrated), cause the compression elements 8 to engage the hollow body 13 under spring pretension in the unpressurized condition of the pressure hose 14. The upper side of the U-shaped hollow body 13 is mounted on the underside of an upper 3D contour plate 16*a* which, in turn, is attached to the underside of the counterplate 2.

As shown in FIG. 1, the lower three-dimensionally formed 3D contour 4 and the upper 3D contour 16 forming the underside of the upper three-dimensionally formed 3D contour plate 16*a* approximately follow the three-dimensional configuration of the sheets 5 and 6. In addition, the width of the compression elements 8 is approximately adapted to the anticipated waviness of the three-dimensionally shaped sheets 5 and 6 to be joined together. The greater the anticipated waviness of the sheets 5 and 6, the smaller the width of the compression elements 8 selected should be, at least in the corresponding sections of the connecting line 7. In order to prevent residual waviness of the sheets 5 and 6 from interfering with laser-beam welding, the counterplate 2 with the 3D contour 16 as well as the hollow body 13 and the compression elements 8 hinged thereto are pivoted downwardly about the rotary joint 3 in relation to the baseplate 1 and then locked in position in a first operation so that the compression curves 11 of the compression elements 8 substantially engage or are adjacent to the upper side of the upper sheet 6.

The inner chamber 15 of the pressure hose 14 is then pressurized, so that the pressure hose 14 acts as a pressure membrane and exerts a force in the direction of the arrow 17 on the horizontal legs 9 of the compression elements 8. As a result of the hinged linkage of the compression elements 8 to the hollow body 13 through the joint 12, the legs 10 of the compression elements 8 extending approximately vertically are pressed in the direction of the arrow 18 onto the upper side of the upper sheet 6. Since the pressure hose 14 presses on the horizontal arms 9 near the joint 12, the extent of the lift at the location of the arrow 18 due to lever action is substantially greater than at the location of the arrow 17 so that, despite a relatively small enlargement in the cross section of the pressure hose 14, the compression curves 11 are pressed against the upper side of the sheet 6 with enough lift so that residual waviness of the sheets 5 and 6 is sufficiently eliminated to permit fillet-weld laser-beam welding along the connecting line 7 without any problem.

Use of the embodiment of a fastening arrangement illustrated in FIG. 1 and FIG. 2 for joining plane, non-three-dimensionally shaped car body components is also possible. In this case, either the 3D-contour plates 4*a* and 16*a* may be omitted, so that, for example, the flat surface of the flat baseplate 1 a forms the locating surface 1, or else substantially flat plates can be used instead of the 3D contour plates 4*a* and 16*a*.

Figure 3:
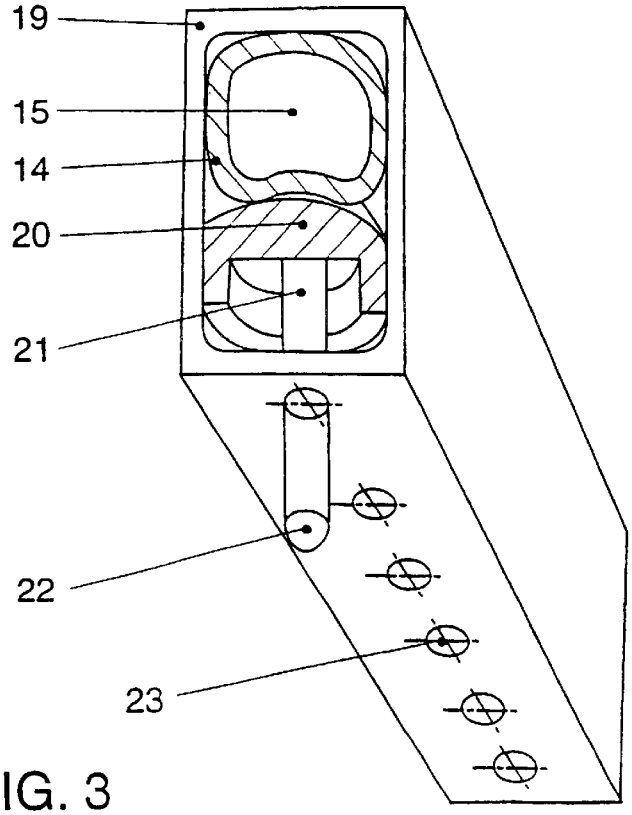
FIG. 3 is a perspective schematic fragmentary view illustrating another representative embodiment of a fastening arrangement according to the invention.

FIG. 3 shows a detail of another typical embodiment of a fastening device according to the invention in which the pressure hose 14 forming the pressure membrane is received in a hollow body 19 that has a substantially rectangular, closed cross section. In this example, the pressure hose 14 does not engage the legs of an L-shaped compression element, but instead engages the heads 20 of a series of pressure cylinders 21 which act as compression elements and have semispherical compression surfaces 22 at their opposite ends to engage the sheet 6. Each pressure cylinder 21 extends through a corresponding circular orifice 23 in one of the narrow sides of hollow body 19.

In a simple embodiment, the fastening arrangement component illustrated in FIG. 3 may, for example, be attached to the underside of a counterplate 2 of the type shown in FIG. 2. The pressure cylinders 21, after pressurization of the inner chamber 15, press on the surface of the upper one of the sheets 5 and 6 which, for example, are laid on the surface 1 of a baseplate 1*a* corresponding to the baseplate 1*a* in FIG. 2. The spacing of the orifices 23, and hence the spacing of the pressure cylinders 21, should be selected so that they correspond to the residual waviness to be expected of the sheets to be welded, so that the gap resulting from the residual waviness is reduced by action of the pressure cylinders 21 on the compression surfaces 22 to a degree tolerable for laser or electron-beam welding.

In order to be able to press together three-dimensionally formed sheets with the fastening arrangement according to the invention shown in FIG. 3, the hollow body 19 may have a 3D contour corresponding to the contour of the sheets. Accordingly, the spacing of the orifices as well as the size and shape of the compression surfaces 22 may be adapted to the three-dimensional contour of the sheets.

Although the invention has been described herein with reference to specific embodiments, many modifications and variations therein will readily occur to those skilled in the art. Accordingly, all such variations and modifications are included within the intended scope of the invention.

I claim:

1. A clamping arrangement for use in joining metal car body components, comprising:

a locating member having a locating surface for supporting at least one of said car body components to be joined, said locating surface having a curved contour; and a clamping component in mechanical communication with said locating member whereby the clamping component is moveably adjustable toward and away from said locating surface, and can be fixed in position with respect to said locating surface, said clamping component having a plurality of adjacent compression elements arranged in a contour corresponding to said curved contour and a hollow body containing a pressure membrane for applying pressure to said plurality of compression elements to press said plurality of compression elements against at least one of said car body components when supported on the locating surface.

2. A clamping arrangement according to claim 1 wherein the clamping component further comprises a lockable rotary joint for pivotal motion with respect to the locating surface about the lockable rotary joint.

3. A clamping arrangement according to claim 1 wherein the pressure membrane is a tubular extensible element arrangement to be coupled to a pneumatic or a hydraulic pressure line.

4. A clamping arrangement according to claim 3 wherein the hollow body has a U-shaped cross section and is open on a side facing the locating surface to permit the pressure membrane to act on the compression elements.

5. A clamping arrangement according to claim 4 wherein the compression elements are pivotally attached to the hollow body.

6. A clamping arrangement according to claim 4 wherein the compression elements each have a substantially L shape, said L shape comprising a parallel leg extending approximately parallel to the locating surface and a perpendicular leg extending approximately perpendicular to the locating surface.

7. A clamping arrangement according to claim 6 wherein each said perpendicular leg faces the locating surface and forms at least a portion of a compression curve.

8. A clamping arrangement according to claim 6 wherein each said parallel leg is pivotally attached to the hollow body at a corresponding joint.

9. A clamping arrangement according to claim 8 wherein said parallel legs have sides which face the locating surface, and wherein the pressure membrane can apply pressure to said sides.

10. A clamping arrangement according to claim 6 wherein the compression elements are positioned adjacent to each other in a direction which is perpendicular to the parallel legs, and which direction is approximately parallel to the locating surface, and wherein the widths of said compression elements in said direction are selected in accordance with an anticipated curved contour of the car body components to be clamped.

11. A clamping arrangement according to claim 1 wherein the locating surface has a 3D contour which substantially conforms to a 3D contour of a car body component.

12. A clamping arrangement according to claim 1 wherein the pressure membrane is a tubular extensible element arrangement coupled to a pneumatic pressure line.

13. A clamping arrangement according to claim 1 wherein the pressure membrane is a tubular extensible element arrangement coupled to a hydraulic pressure line.

* * * * *